US006908046B1

(12) United States Patent
Jordan

(10) Patent No.: US 6,908,046 B1
(45) Date of Patent: Jun. 21, 2005

(54) SELF PROPELLED FENCE PAINTING SYSTEM

(76) Inventor: Danny E. Jordan, Rte. 1 Box 254, Shinnston, WV (US) 26431

( * ) Notice: Subject to any disclaimer, the term of this patent is extended or adjusted under 35 U.S.C. 154(b) by 143 days.

(21) Appl. No.: 10/126,267

(22) Filed: Apr. 19, 2002

(51) Int. Cl.[7] ..... B05B 9/03

(52) U.S. Cl. ..... 239/146; 239/DIG. 14; 239/147; 239/752; 118/316; 118/323; 134/172; 134/199

(58) Field of Search ..... 239/146, 264, 239/265, 722, 750, 752, DIG. 14, 173, 176, 239/147, 261, 263.3; 118/313, 315, 316, 118/323, 694; 134/172, 199, 104.2

(56) References Cited

U.S. PATENT DOCUMENTS

| | | | | | |
|---|---|---|---|---|---|
| 2,465,562 | A | * | 3/1949 | Hopper et al. | 134/94.1 |
| 2,489,445 | A | * | 11/1949 | Benzuly | 118/305 |
| 3,072,131 | A | * | 1/1963 | Di Laurenzio | 134/123 |
| 3,288,109 | A | * | 11/1966 | Smith, Jr. et al. | 118/316 |
| 3,612,077 | A | * | 10/1971 | Capro | 134/123 |
| 3,842,745 | A | | 10/1974 | Jones, III | 104/93 |
| 3,861,594 | A | | 1/1975 | Wending | 239/1 |
| 4,353,324 | A | | 10/1982 | Schnittker | 118/207 |
| D274,088 | S | | 5/1984 | Nilsson et al. | D15/199 |
| D287,749 | S | | 1/1987 | Nilsson | D23/314 |
| 4,793,559 | A | * | 12/1988 | Marlek | 239/722 |
| 5,028,002 | A | | 7/1991 | Whitford | 239/8 |
| 5,228,621 | A | * | 7/1993 | Wilson et al. | 239/99 |
| 5,346,140 | A | * | 9/1994 | Campbell | 239/750 |

FOREIGN PATENT DOCUMENTS

| | | | | |
|---|---|---|---|---|
| EP | 291837 | A1 | * 11/1988 | A01G 25/09 |

* cited by examiner

*Primary Examiner*—Patrick Brinson

(57) ABSTRACT

A self propelled fence painting system for painting a length of fence. The self propelled fence painting system includes a housing that includes a front wall, a back wall and an upper end wall that is coupled to and extends between the front and back walls. The front and back walls are spaced away from each other defining a paint spraying space between the front and back walls of the housing. In one embodiment of the present invention, a portion of the fence to be painted is positionable in the paint spraying space. A drive assembly is mounted on the front wall of the housing for driving the housing on a surface. A spraying assembly is mounted on the front and back walls of the housing for spraying paint into the paint spraying space of the housing. A plurality of guide assemblies guides the system along the length of the fence.

20 Claims, 6 Drawing Sheets

SELF PROPELLED FENCE PAINTING SYSTEM

BACKGROUND OF THE INVENTION

1. Field of the Invention

The present invention relates to painting systems and more particularly pertains to a new self propelled fence painting system for painting a length of fence.

2. Description of the Prior Art

The use of painting systems is known in the prior art. More specifically, painting systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,861,594; U.S. Pat. No. 3,842,745; U.S. Pat. No. 4,353,324; U.S. Pat. No. 5,028,002; U.S. Pat. No. Des. 274,088; and U.S. Pat. No. Des. 287,749.

While these devices fulfill their respective, particular objectives and requirements, the aforementioned patents do not disclose a new self propelled fence painting system. The inventive device includes a housing that includes a front wall, a back wall and an upper end wall that is coupled to and extends between the front and back walls. The front and back walls are spaced away from each other defining a paint spraying space between the front and back walls of the housing. In one embodiment of the present invention, a portion of the fence to be painted is positionable in the paint spraying space. A drive assembly is mounted on the front wall of the housing for driving the housing on a surface. A spraying assembly is mounted on the front and back walls of the housing for spraying paint into the paint spraying space of the housing.

In these respects, the self propelled fence painting system according to the present invention substantially departs from the conventional concepts and designs of the prior art, and in so doing provides an apparatus primarily developed for the purpose of painting a length of fence.

SUMMARY OF THE INVENTION

In view of the foregoing disadvantages inherent in the known types of painting systems now present in the prior art, the present invention provides a new self propelled fence painting system construction wherein the same can be utilized for painting a length of fence.

The general purpose of the present invention, which will be described subsequently in greater detail, is to provide a new self propelled fence painting system apparatus and method which has many of the advantages of the painting systems mentioned heretofore and many novel features that result in a new self propelled fence painting system which is not anticipated, rendered obvious, suggested, or even implied by any of the prior art painting systems, either alone or in any combination thereof.

To attain this, the present invention generally comprises a housing that includes a front wall, a back wall and an upper end wall that is coupled to and extends between the front and back walls. The front and back walls are spaced away from each other defining a paint spraying space between the front and back walls of the housing. In one embodiment of the present invention, a portion of the fence to be painted is positionable in the paint spraying space. A drive assembly is mounted on the front wall of the housing for driving the housing on a surface. A spraying assembly is mounted on the front and back walls of the housing for spraying paint into the paint spraying space of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self propelled fence painting system apparatus and method which has many of the advantages of the painting systems mentioned heretofore and many novel features that result in a new self propelled fence painting system which is not anticipated, rendered obvious, suggested, or even implied by any of the prior art painting systems, either alone or in any combination thereof.

It is another object of the present invention to provide a new self propelled fence painting system which may be easily and efficiently manufactured and marketed.

It is a further object of the present invention to provide a new self propelled fence painting system which is of a durable and reliable construction.

An even further object of the present invention is to provide a new self propelled fence painting system which is susceptible of a low cost of manufacture with regard to both materials and labor, and which accordingly is then susceptible of low prices of sale to the consuming public, thereby making such self propelled fence painting system economically available to the buying public.

Still yet another object of the present invention is to provide a new self propelled fence painting system which provides in the apparatuses and methods of the prior art some of the advantages thereof, while simultaneously overcoming some of the disadvantages normally associated therewith.

Still another object of the present invention is to provide a new self propelled fence painting system for painting a length of fence.

Yet another object of the present invention is to provide a new self propelled fence painting system which includes a housing that includes a front wall, a back wall and an upper end wall that is coupled to and extends between the front and back walls. The front and back walls are spaced away from each other defining a paint spraying space between the front and back walls of the housing. In one embodiment of the present invention, a portion of the fence to be painted is positionable in the paint spraying space. A drive assembly is mounted on the front wall of the housing for driving the housing on a surface. A spraying assembly is mounted on the front and back walls of the housing for spraying paint into the paint spraying space of the housing.

Still yet another object of the present invention is to provide a new self propelled fence painting system that makes painting a fence a quick, easy and efficient process.

Even still another object of the present invention is to provide a new self propelled fence painting system that saves a user time and money, by allowing the a single user to paint a fence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
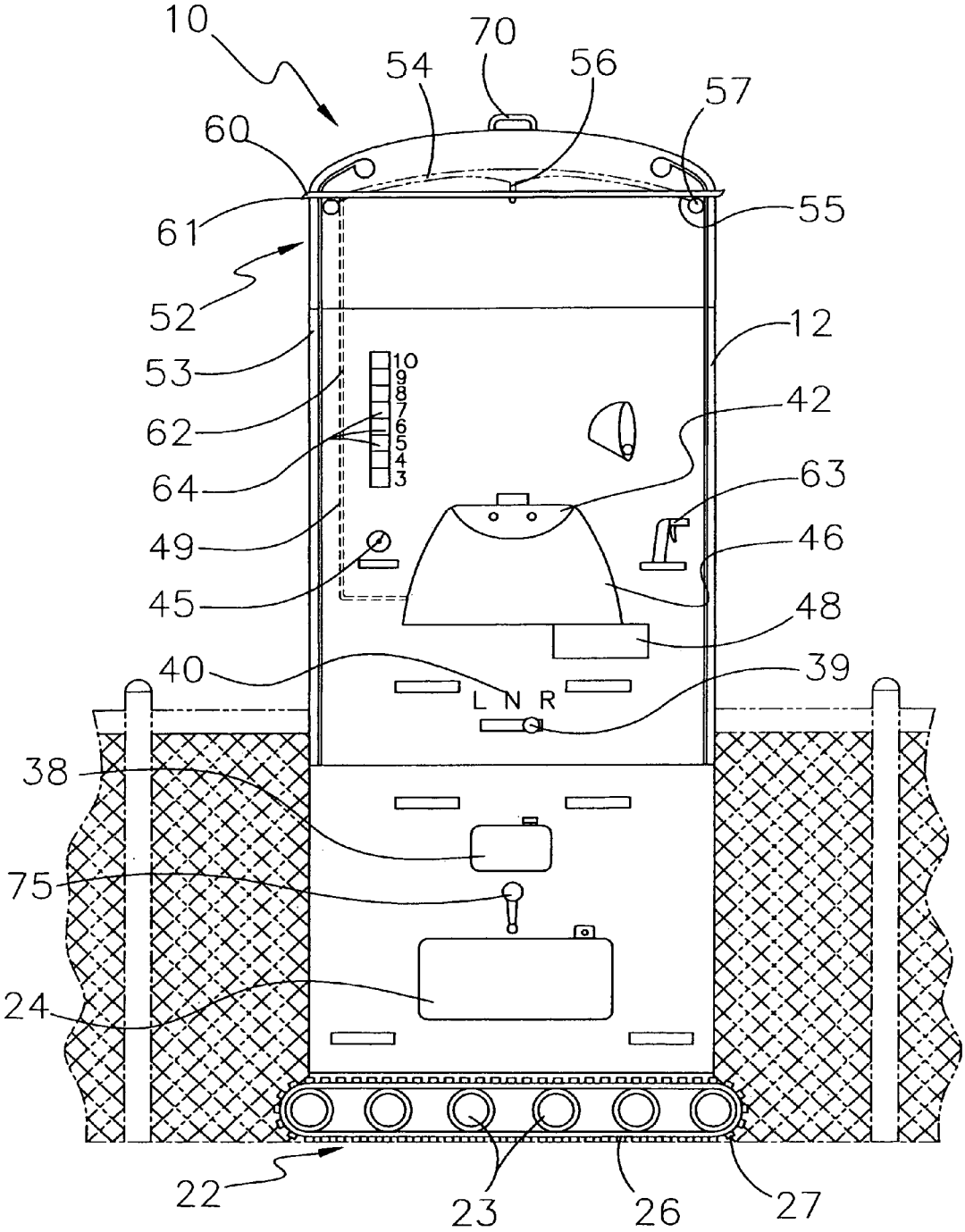
FIG. 1 is a schematic frontal view of a new self propelled fence painting system according to the present invention.

With reference now to the drawings, and in particular to FIGS. 1 through 6 thereof, a new self propelled fence painting system embodying the principles and concepts of the present invention and generally designated by the reference numeral 10 will be described.

As best illustrated in FIGS. 1 through 6, the self propelled fence painting system 10 generally comprises a housing 12 that includes a front wall 13 and a back wall 14 spaced away from the front wall 13. The front 13 and back 14 walls may include an inner panel 15, an outer panel 16 and a pair of peripheral side panels 17 extending between the inner 15 and outer 16 panels of the front 13 and back 14 walls of the housing 12. The inner 15, outer 16 and peripheral 17 side panels define an interior 18 of the front 13 and back 14 walls of the housing 12.

A distance between the inner panels 15 of the front 13 and back 14 walls defines a paint spraying space 31. In one embodiment of the present invention, as particularly illustrated in FIG. 2, a portion of the fence to be painted may be positionable in the paint spraying space 31.

An upper end wall 19 is coupled to and extends between the front 13 and back 14 walls. The front 13 and back 14 walls may include a longitudinal axis extending between the upper end wall 19 and an end 20 of each of the front 13 and back 14 walls opposite the upper end wall 19.

Figure 3:
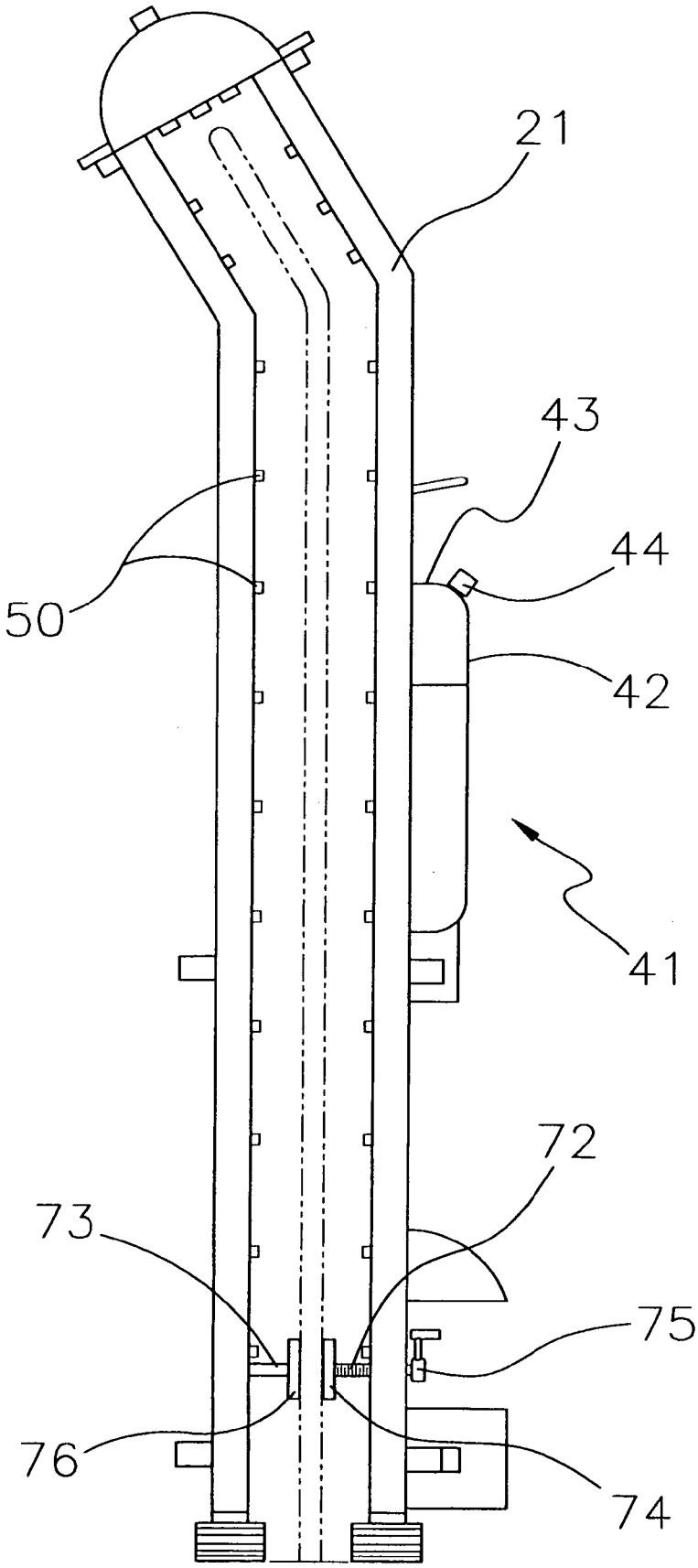
FIG. 3 is a schematic cross-sectional view of an alternate embodiment of the present invention.
Figure 4:
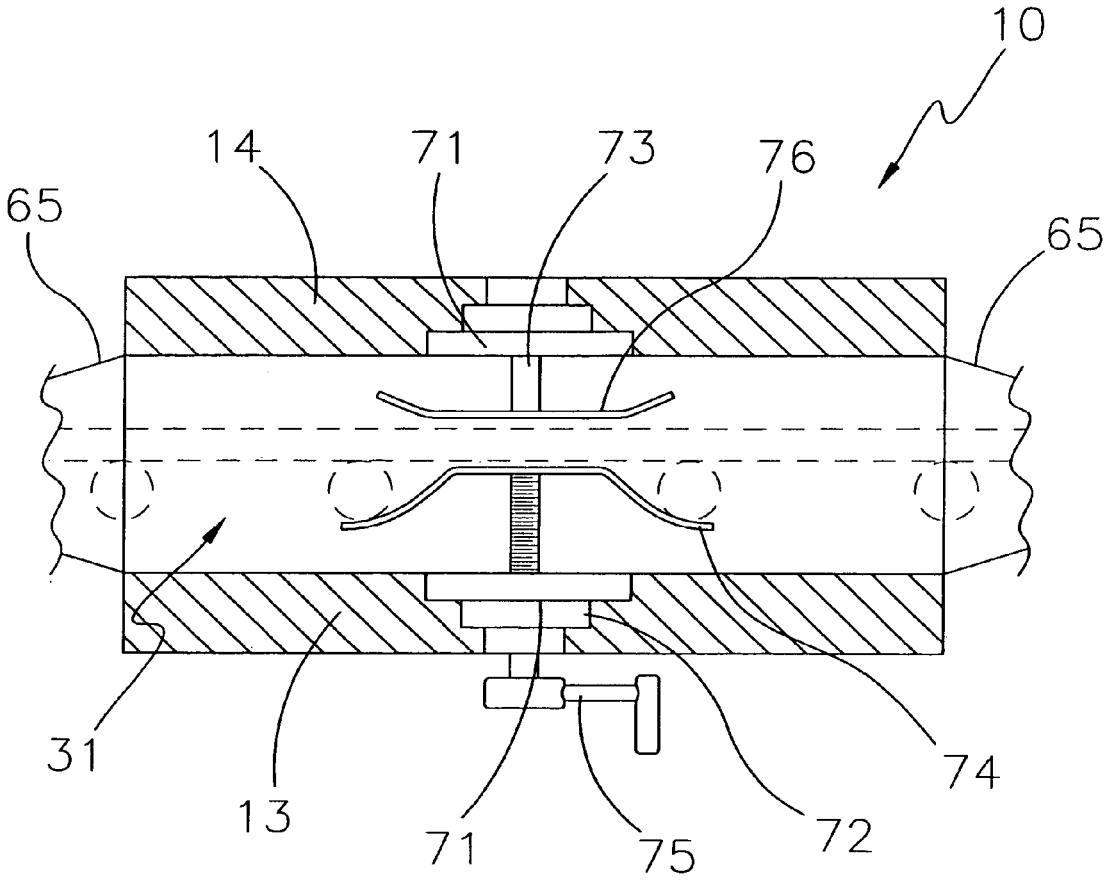
FIG. 4 is a schematic top view of the guide assembly of the present invention.
Figure 5:
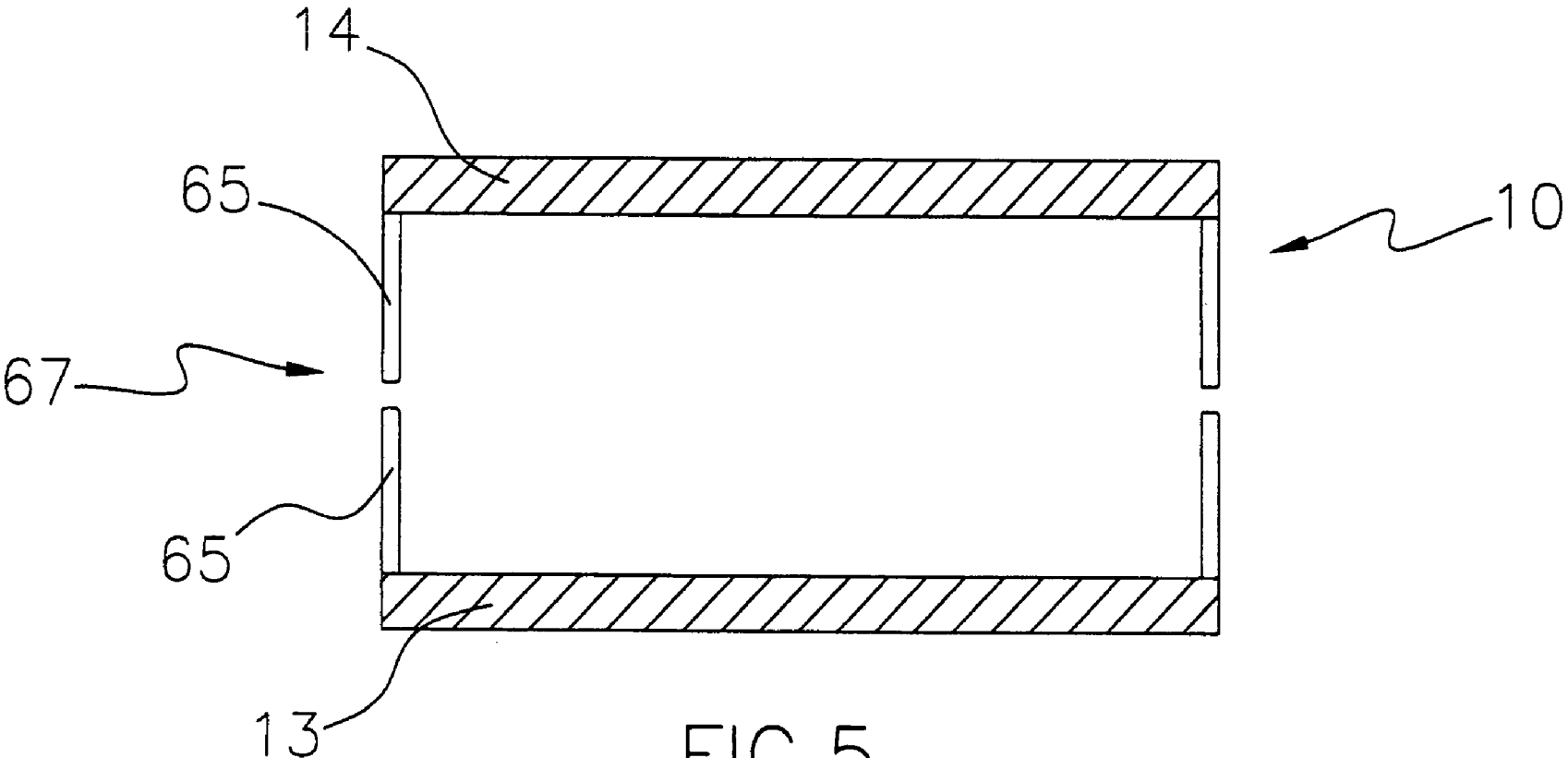
FIG. 5 is a schematic top view of the doors of the present invention in the closed position.
Figure 6:
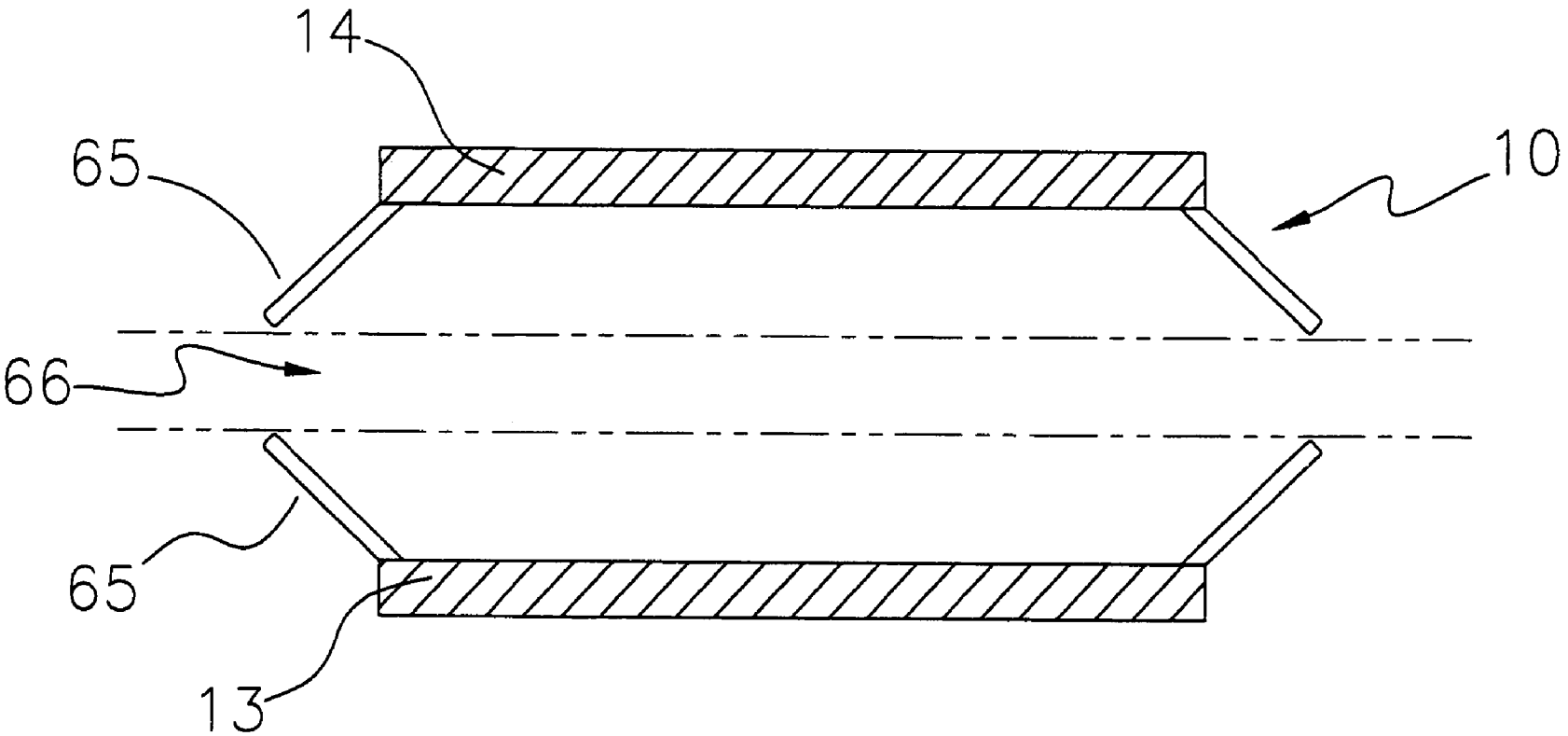
FIG. 6 is a schematic top view of the doors of the present invention in the open position.

In an alternate embodiment of the present invention, as particularly illustrated in FIG. 3, the front 13 and back 14 walls of the housing 12 may each include a bend 21 therein for positioning the housing 12 over a fence that includes barb wire. The bend 21 may be positioned generally nearer the upper end wall 19 of the housing 12 than the end 20 of the front 13 and back 14 walls of the housing 12.

The housing 12 may have a height measuring approximately five feet, however, housings 12 measuring greater than or less than five feet may be employed. The housing 12 may comprise a substantially rigid material such as, for example, an aluminum material.

A drive assembly 22 is mounted on the front wall 13 of the housing 12 for driving the housing 12 on a surface. The drive assembly 12 may include a plurality of wheels 23 that are rotatably mounted on the end 19 of the front 13 and back 14 walls of the housing 12. Each of the wheels 23 are preferably spaced apart from each other along the end 19 of the front 13 and back 14 walls of the housing 12.

The drive assembly 22 additionally includes a motor 24 for selectively rotating the plurality of wheels 23. The motor 24 may be mounted on the outer panel 16 of the front wall 13 of the housing 12. The motor 24 may include a motor shaft 25 extending into the interior 18 of the front wall 13 of the housing 12. The motor 24 may be positioned generally adjacent to the end 19 of the front wall 13.

A track member 26 may be operationally mounted on the plurality of wheels 23 of the front 13 and back 14 walls of the housing 12 to aid the housing 12 in moving over a rough surface. The track member 26 may include a plurality of track shoes 27 pivotally coupled together. The track member 26 may comprise a generally flexible material such as, for example, a rubber or vinyl material.

Figure 2:
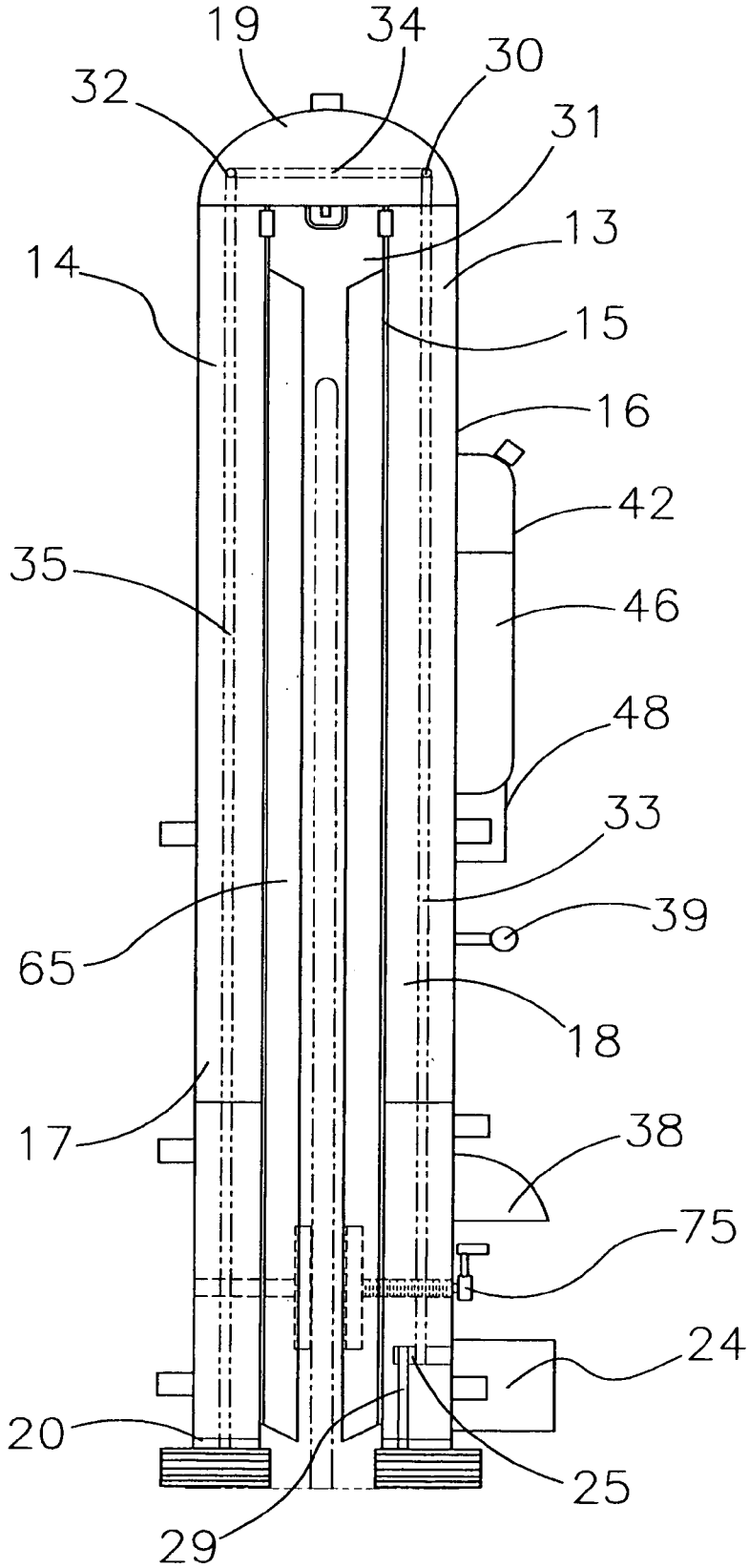
FIG. 2 is a schematic side view of the present invention.

As particularly illustrated in FIG. 2, the drive assembly 22 may include a first coupling member 29 for operationally coupling the motor 24 to the plurality of wheels 23 on the front wall 13 of the housing 12. The coupling member 29 is preferably coupled to and extending between the motor shaft 25 and the plurality of wheels 23 on the front wall 13 of the housing 12.

In one embodiment of the present invention, the drive assembly 22 may include a first drive shaft 30 that is rotatably mounted in the interior 18 of the front wall 13 of the housing 12. The first drive shaft 30 may extend between the pair of peripheral side panels 17 of the front wall 13 of the housing 12.

A second drive shaft 32 may be rotatably mounted in the interior 18 of the back wall 14 of the housing 12. The second drive shaft 32 may extend between the pair of peripheral side panels 17 of the back wall 14 of the housing 12. A second coupling member 33 may be provided for rotatably turning the first drive shaft 30. The second coupling member 33 may be operationally coupled to and extending between the motor shaft 25 and the second drive shaft 30.

A third coupling member 34 may be provided for rotatably turning the second drive shaft 32. The third coupling member 34 may be coupled to and extending between the first drive shaft 30 and the second drive shaft 32. A fourth coupling member 35 may be provided for rotatably turning the plurality of wheels 23 mounted on the end 20 of the back wall 14 of the housing 12. The fourth coupling member 34 may be coupled to and extending between the second drive shaft 32 and the plurality of wheels 23 mounted on the end 20 of the back wall 14 of the housing 12.

In one embodiment of the present invention, the housing 12 moves along a fence by the motor shaft 25 rotating the second coupling member 33 which rotates the first drive shaft 30. Rotation of the first drive shaft 30 rotates the third coupling member 34 which rotates the second drive shaft 32. The rotation of the second drive shaft 32 rotates the fourth coupling member 35 which rotates the plurality of wheels 23 mounted on the back wall 14 of the housing 12. The first 29, second 33, third 34 and fourth 35 coupling members may comprise a chain, however other types of coupling members may be employed.

A power supply 38 may be provided for selectively providing power to the motor 24. The power supply 38 may be mounted on the outer panel 16 of the front wall 13 of the housing 12. The power supply 38 is preferably operationally coupled to the motor 24. The power supply 38 may comprise a tank for holding a fuel. The power supply 37 may also comprise a battery that is electrically connected to the motor 24.

An actuating means 39 may be provided for selectively controlling a rightward and leftward direction of rotation of the motor shaft 25. The actuating means 39 may be mounted on the outer panel 16 of the front wall 13 of the housing 12. The actuating means 39 may be electrically connected to the to the motor 24. In one embodiment of the present invention, the rightward rotation of the motor shaft 25 moves the housing 12 in a rightward direction with respect to the fence and the leftward rotation of the motor shaft 25 moves the housing 12 in a leftward direction with respect to the fence.

Indicia 40 may be marked on the outer panel 16 of the front wall 13 of the housing 12 for indicating to a user a movement of direction of the housing 12 with respect to the fence. The indicia 40 may include an L for indicating the leftward movement of the housing 12 with respect to the fence, an R for indicating the rightward movement of the housing 12 with respect to the fence and an N for indicating a lack of movement of the housing with respect to the fence.

A spraying assembly 41 is provided for spraying paint into the paint spraying space of the housing 12. The paint spraying assembly 41 may include at least one container 42 for holding paint or any other type of material a user may want to spray onto a fence. The container 42 may be mounted on the front wall 13 of the housing 12. The container 42 may include an end 43 with an access opening 44 for pouring paint into the container 42.

The spraying assembly 41 may include a paint gauge 45 for measuring an amount of paint in the container 42. The paint gauge 45 may be mounted on the outer panel 16 of the front wall 13 of the housing 12 and is preferably operationally coupled to the container 42. The paint gauge 45 may employ a float to measure an amount of paint in the container 42.

The spraying assembly 41 may also include a compressing means 46 for exerting pressure on a volume of air in the container 42 creating a pressurized stream of paint. The compressing means 46 may be mounted on the outer panel 16 of the front wall 13 of the housing 12 and may be positioned generally adjacent to the container 42. The compressing means 46 is preferably fluidly coupled to the container 42. The compressing means 46 may comprise an air compressor.

A power source 48 may be provided for selectively providing power to the compressing means 46. The power source 48 may be mounted on the outer panel 16 of the front wall 13 of the housing 12 and is preferably electrically connected to the compressing means 46. The power source 48 may comprise a battery.

A switch means 49 may be provided for selectively controlling the compressing means 46. The switch means 49 may be mounted on the outer panel 16 of the front wall 13 of the housing 12. The switch means 49 may include an ON position and an OFF position. The switch means 49 is electrically connected to the power source 48 and the compressing means 46. In one embodiment of the present invention, the switch means 49 permits the power source to provide the compressing means 46 with power when the switch means 49 is in the ON position. The switch means 49 prevents the power source 49 from providing power to the compressing means 46 when the switch means 49 is in the OFF position.

The spray assembly 41 may additionally include a plurality of nozzles 50 for emitting paint into the painting spraying space. Each of the nozzles 50 is preferably mounted on the inner panel 15 of the front 13 and back 14 walls of the housing 12. Each of the nozzles 50 may be spaced apart from each other between the upper end wall 19 and the ends 20 of the front 13 and back 14 walls. Each of the nozzles 50 may be fluidly coupled to the container 42 such that the pressurized stream of paint exits each of the plurality of nozzles 50 when the switch means 49 is in the ON position.

In one embodiment of the present invention, as particularly illustrated in FIG. 1, an adjustable nozzle assembly 52 may be provided for spraying paint on a top surface of a fence positioned in the paint spraying space 31. The adjustable nozzle assembly 52 may include a pair of guide rails 53 that may be mounted on the inner panel 16 of the front wall 13 of the housing 12. Each of the guide rails 53 may extend between the upper end wall 19 and the end 20 of the front wall 12. Each of the guide rails 53 may be positioned generally adjacent to the pair of peripheral side panels 17 of the front wall 13 of the housing 12.

The adjustable nozzle assembly 52 may also include an elongated cylinder 54 that includes a pair of opposite ends 55 and at least one nozzle 56 that is fluidly coupled to and extending away from the elongated cylinder 54. The elongated cylinder 54 may include a generally arcuate shape.

A pair of rollers 57 may be mounted on the opposite ends 55 of the elongated cylinder 54 for moving the elongated cylinder 54 in the pair of guide rails 53. A securing means 60 may be provided for securing the elongated cylinder 54 in a position with respect to the guide rails 53. The securing means 60 may be pivotal ly mounted on the opposite ends 55 of the elongated cylinder 54. The securing means 60 may include an end 61 that is selectively engagable with a portion of the pair of guide rails 53. The securing means 60 may comprise a latch.

A conduit 62 may be provided for transporting the pressurized stream of paint from the container 42 to the elongated cylinder 54. The conduit 62 is preferably coupled to and extending between the elongated cylinder 54 and the container 42. In one embodiment of the present invention, the pressurized stream of paint travels in the conduit 62, through the elongated cylinder and is emitted from the nozzle 56 mounted on the elongated cylinder 54.

A hand nozzle 63 may be provided for spraying paint by hand. The hand nozzle 63 may be retractably mounted on the outer panel 16 of the front wall 13 of the housing 12. The hand nozzle 63 may be positioned generally adjacent to the compressing means 46 and may be fluidly coupled to the container 42.

A plurality of buttons 64 may be provided for selecting a portion of the plurality of nozzles 50 to emit paint. Each of the buttons 64 may be depressibly mounted on the outer panel 16 of the front wall 13 of the housing 12 and may be positioned generally adjacent to the compressing means 46. The plurality of buttons 64 may include a button for various sized fences such as, for example, a three-foot, four-foot, five-foot, six-foot, seven-foot, eight-foot, nine-foot and ten-foot button.

A pair of guide assemblies guides the housing along the length of the fence. The pair of guide assemblies comprises a front guide assembly 71 72 and a back guide assembly 73 71, each being mounted on the front wall and the back wall respectively and is positioned in the paint spraying space.

The front guide assembly 71 72 has a front guide plate 74 for selectively abutting a front side of the fence. The front guide assembly 71 72 includes a positioning member 75 for selectively moving the front guide plate 74 between the front housing and the fence. The front side guide plate is operationally coupled to the positioning member 75.

The back guide assembly 73 71 has a back guide plate 76 for abutting a bock side of the fence. The back guide plate 76 is mounted on and extends away from the back wall.

The front guide assembly 71 72 is positionable against the front side of the fence in such a manner so that the fence is positioned between the front guide plate 74 and the back guide plate 76 to facilitate centering of the housing with respect to the fence as the housing progressively moves along the length of the fence.

A plurality of doors 65 may be provided for restricting the paint that is emitted from the plurality of nozzles 50 from leaving the paint spraying space 31 of the housing 12. Each of the doors 65 are hingably mounted on the pair of peripheral side panels 17 of front 13 and back 14 walls of the housing 12 such that each of the doors 65 are positionable between an open position 66 and a closed position 67.

The open position 66 is characterized by a plane of the doors 65 being oriented substantially parallel to a plane of the panels 15, 16. The closed position is characterized by a plane of the doors 65 being oriented substantially perpendicular to a plane of the panels 15, 16.

The plurality of doors 65 may comprise a generally flexible material such as, for example, a rubber or plastic material.

The housing 12 may include a plurality of handles 70 for carrying the housing 12. Each of the handles 70 may be mounted on the outer panels 16 of the front 13 and back 14 walls of the housing.

In use, the housing 12 is placed over a portion of fence such that the fence is positioned in the paint spraying space 31. Once the housing 12 is positioned, a user starts the motor 24 that will drive the plurality of wheels 23 to move the housing 12 along the fence. Depending upon the height of the fence, a user may adjust the adjustable nozzle assembly 52 to desired position above the top of the fence. A user then moves the actuating means 39 to the desired direction and depresses the switching means 49 to switch on the compressing means 46 to begin emitting paint through the plurality of nozzles 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self propelled fence painting system for painting a length of a fence, said system comprising:

a housing having a front wall, a back wall and an upper end wall being coupled to and extending between said front and back walls, said back wall being spaced away from said front wall to define a paint spraying space between said front and back walls of said housing, wherein a portion of the fence to be painted is positionable in said paint spraying space;

a drive assembly being mounted on said front wall of said housing for moving said housing on a surface;

a spraying assembly being mounted on said front and back walls of said housing for spraying paint into said paint spraying space of said housing; and said front and back walls of said housing each having a bend formed therein for positioning said housing over a fence having barb wire.

2. The self propelled fence painting system of claim 1, wherein said front and back walls each include an inner panel, an outer panel and a pair of peripheral side panels, said pair of peripheral side panels extending between said inner and outer panels of said front and back walls of said housing to define an interior for each of said front and back walls of said housing, wherein a distance between said inner panels of said front and back walls defines said paint spraying space.

3. The self propelled fence painting system of claim 2, wherein said drive assembly includes:

a plurality of wheels being rotatably mounted on an end of said front and back walls of said housing;

a motor for selectively rotating said plurality of wheels, said motor being mounted on said front wall of said housing, said motor having a motor shaft extending into said interior of said front wall of said housing;

a first coupling member for operationally coupling said motor to said plurality of wheels, said coupling member being coupled to and extending between said motor shaft and said plurality of wheels on said front wall of said housing;

a power supply for selectively providing power to said motor and being operationally coupled to said motor; and an actuating means for selectively controlling a rightward and leftward direction of rotation of said motor, said actuating means being electrically connected to said to said motor.

4. The self propelled fence painting system of claim 3, additionally including a track member for engaging a surface, said track member being mounted on said plurality of wheels of said front and back walls of said housing, said track member including a plurality of track shoes pivotally coupled together.

5. The self propelled fence painting system of claim 3, additionally including a first drive shaft being rotatably mounted in said interior of said front wall of said housing, said first drive shaft extending between said pair of peripheral side panels of said front wall of said housing;

a second drive shaft being rotatably mounted in said interior of said back wall of said housing, said second drive shaft extending between said pair of peripheral side panels of said back wall of said housing;

a second coupling member for rotatably turning said first drive shaft, said second coupling member being operationally coupled to and extending between said motor shaft and said second drive shaft;

a third coupling member for rotatably turning said second drive shaft, said third coupling member being coupled to and extending between said first drive shaft and said second drive shaft;

a fourth coupling member for rotatably turning said plurality of wheels mounted on said end of said back wall of said housing, said fourth coupling member being operationally coupled to and extending between said second drive shaft and said plurality of wheels mounted on said end of said back wall of said housing; and wherein each of said first, second, third and fourth coupling members comprises a chain.

6. The self propelled fence painting system of claim 1, further comprising a pair of guide assemblies for guiding said housing along the length of the fence, said pair of guide assemblies comprising a front guide assembly and a back guide assembly each being mounted on said front wall and said back wall respectively and being positioned in said paint spraying space.

7. The self propelled fence painting system of claim 6, further comprising said front guide assembly having a front guide plate for selectively abutting a front side of the fence, said front guide assembly including a positioning member for selectively moving said front guide plate between said front housing and the fence, said front side guide plate being operationally coupled to said positioning member.

8. The self propelled fence painting system of claim 6, further comprising said back guide assembly having a back guide plate for abutting a bock side of the fence, said back guide plate being mounted on and extending away from said back wall.

9. The self propelled fence painting system of claim 6, wherein said front guide assembly is positionable against the front side of the fence in such a manner so that the fence is positioned between said front guide assembly and said back guide assembly to facilitate centering of said housing with respect to the fence as said housing progressively moves along the length of the fence.

10. The self propelled fence painting system of claim 2, wherein said paint spraying assembly includes:

at least one container for holding paint, said at least one container being mounted on said front wall of said housing, said at least one container having an end, said end of said at least one container having an access opening for receiving paint poured into said at least one container;

a compressing means for exerting pressure on a volume of air in said container creating a pressurized stream of paint, said compressing means being mounted on said front wall of said housing and fluidly coupled to said at least one container;

a power source for selectively providing power to said compressing means, said power source being electrically connected to said compressing means; and a plurality of nozzles for emitting paint into said painting area, each of said nozzles being mounted on said inner panel of said front and back walls of said housing, each of said nozzles being fluidly coupled to said at least one container.

11. The self propelled fence painting system of claim 10, additionally including a switch being electrically connected to said power source and compressing means for selectively controlling said compressing means.

12. The self propelled fence painting system of claim 10 additionally including a paint gauge for measuring an amount of paint in said at least one container.

13. The self propelled fence painting system of claim 10 additionally including an adjustable nozzle assembly mounted on said inner panel of said front wall for spraying paint on a top surface of a fence, said adjustable nozzle assembly including:

an elongated cylinder having a pair of opposite ends;

at least one nozzle being fluidly coupled to and extending away from said elongated cylinder; and a conduit for transporting said pressurized stream of paint from said at least one container to said elongated cylinder, said conduit being coupled to and extending between said elongated cylinder and said at least one container, wherein the pressurized stream of paint travels from said container through said conduit and through said elongated cylinder, wherein the pressurized stream of paint is emitted from said nozzle.

14. The self propelled fence painting system of claim 13, additionally including a pair of guide rails being mounted on said inner panel of said front wall of said housing, each of said guide rails extending between said upper end wall and said end of said front wall; and a pair of rollers being mounted on said opposite ends of said elongated cylinder, each of said rollers being rotatably positioned in said pair of guide rails, wherein said elongated cylinder may be moved along said guide rails.

15. The self propelled fence painting system of claim 14, additionally including a securing means for securing said elongated cylinder in a position with respect to said guide rails, said securing means being pivotally mounted on said opposite ends of said elongated cylinder, said securing means having an end, said end of said securing means being selectively engaged with a portion of said pair of guide rails.

16. The self propelled fence painting system of claim 10, additionally including a hand nozzle for spraying paint by band, said hand nozzle being retractably mounted on said front wall of said housing, said hand nozzle being fluidly coupled to said at least one container.

17. The self propelled fence painting system of claim 10, additionally including a plurality of buttons for selecting a portion of said plurality of nozzles to spray paint, each of said buttons being mounted on said outer panel of said front wall of said housing.

18. The self propelled fence painting system of claim 10, additionally including a plurality of doors for restricting the paint being emitted from said plurality of nozzles from leaving said painting space of said housing, each of said doors being hingably mounted on said pair of peripheral side panels of said front and back walls of said housing such that each of said doors are positionable between an open position and a closed position; and wherein said open position is characterized by a plane of said doors being oriented substantially parallel to a plane of said panels, and said closed position is characterized by a plane of said doors being oriented substantially perpendicular to a plane of said panels.

19. A self propelled fence painting system for painting a length of a fence, said system comprising:

a housing having a front wall, a back wall and an upper end wall being coupled to and extending between said front and back walls, said back wall being spaced away from said front wall to define a paint spraying space between said front and back walls of said housing, wherein a portion of the fence to be painted is positionable in said paint spraying space;

a drive assembly being mounted on said front wall of said housing for moving said housing on a surface;

a spraying assembly being mounted on said front and back walls of said housing for spraying paint into said paint spraying space of said housing;

a pair of guide assemblies for guiding said housing along the length of the fence, said pair of guide assemblies comprising a front guide assembly and a back guide assembly each being mounted on said front wall and said back wall respectively and being positioned in said paint spraying space; and said front guide assembly having a front guide plate for selectively abutting a front side of the fence, said front guide assembly including a positioning member for selectively moving said front guide plate between said front housing and the fence, said front side guide plate being operationally coupled to said positioning member.

20. A self propelled fence painting system for painting a length of a fence, said system comprising:

a housing having a front wall, a back wall and an upper end wall being coupled to and extending between said front and back walls, said back wall being spaced away from said front wall to define a paint spraying space between said front and back walls of said housing, wherein a portion of the fence to be painted is positionable in said paint spraying space;

a drive assembly being mounted on said front wall of said housing for moving said housing on a surface;

a spraying assembly being mounted on said front and back walls of said housing for spraying paint into said paint spraying space of said housing;

a pair of guide assemblies for guiding said housing along the length of the fence, said pair of guide assemblies comprising a front guide assembly and a back guide assembly each being mounted on said front wall and said back wall respectively and being positioned in said paint spraying space; and said back guide assembly having a back guide plate for abutting a bock side of the fence, said back guide plate being mounted on and extending away from said back wall.

* * * * *